US008430800B2

(12) United States Patent
Nolan et al.

(10) Patent No.: US 8,430,800 B2
(45) Date of Patent: Apr. 30, 2013

(54) LEG EXERCISE MACHINE

(76) Inventors: Gregory Joseph Nolan, Marlton, NJ (US); Brian Robert McGinty, Feasterville, PA (US)

( * ) Notice: Subject to any disclaimer, the term of this patent is extended or adjusted under 35 U.S.C. 154(b) by 285 days.

(21) Appl. No.: 12/012,986

(22) Filed: Feb. 7, 2008

(65) Prior Publication Data

US 2009/0203507 A1 Aug. 13, 2009

(51) Int. Cl.
*A63B 21/04* (2006.01)

(52) U.S. Cl.
USPC ..... 482/130; 482/121; 482/122

(58) Field of Classification Search ..... 482/70, 482/71, 72, 79, 80, 83, 87, 121–130, 133–137, 482/141, 907; 601/33, 34; 473/438, 441–445
See application file for complete search history.

(56) References Cited

U.S. PATENT DOCUMENTS 1,738,987 A * 12/1929 Dattilo ..... 482/72
1,750,549 A * 3/1930 Thomson et al. ..... 482/72
1,866,868 A * 7/1932 Hardy et al. ..... 482/72
1,950,174 A * 3/1934 Harrison ..... 482/130
1,996,350 A * 4/1935 Schaff ..... 482/96
2,440,577 A * 4/1948 Denby ..... 473/441
2,720,396 A * 10/1955 Pfaus ..... 482/130
3,620,530 A * 11/1971 Cosby ..... 482/130
3,749,400 A * 7/1973 Stoffel ..... 482/123
3,754,547 A * 8/1973 Walker ..... 601/24
3,770,267 A * 11/1973 McCarthy ..... 482/130
3,992,004 A * 11/1976 Feron et al. ..... 482/128
4,111,417 A * 9/1978 Gardner ..... 482/128
4,522,392 A * 6/1985 Torii ..... 482/128
4,619,454 A * 10/1986 Walton ..... 482/128
4,706,953 A * 11/1987 Graham ..... 482/96
4,809,976 A * 3/1989 Berger ..... 482/130
4,867,443 A * 9/1989 Jensen ..... 482/70
4,930,769 A * 6/1990 Nenoff ..... 482/96
5,279,530 A * 1/1994 Hess ..... 482/70
5,295,935 A * 3/1994 Wang ..... 482/130
5,328,427 A * 7/1994 Sleamaker ..... 482/71
5,330,398 A * 7/1994 Barbafieri et al. ..... 482/23
5,338,278 A * 8/1994 Endelman ..... 482/142
5,364,327 A * 11/1994 Graham ..... 482/122
D362,700 S * 9/1995 Breibart et al. ..... D21/673
5,499,958 A * 3/1996 Hess ..... 482/79
5,518,483 A * 5/1996 Oswald ..... 482/131
5,607,381 A * 3/1997 Endelman ..... 482/142
5,620,403 A * 4/1997 Lundin ..... 482/96
5,653,670 A * 8/1997 Endelman ..... 482/142
5,681,249 A * 10/1997 Endelman ..... 482/142
5,792,079 A * 8/1998 Hatfield ..... 601/49
6,001,051 A * 12/1999 Chuan-Pin ..... 482/131
6,042,523 A * 3/2000 Graham ..... 482/121

(Continued)

*Primary Examiner* — Glenn Richman

(57) ABSTRACT

The invention is directed to be a hand portable exercise and training machine to improve the user's initial linear quickness and speed from a stationary or set position. The machine consists of a horizontal beam mounted above the floor with a movable foot sled, a stationary spring retainer bracket and a removable handle bar post and assembly mounted on it. Springs are attached to the front of the foot sled and the opposite end of the springs are attached to the stationary retainer bracket adjacent to the vertical handle bar post. The invention is an exercise device that applies spring resistance to the full range of motion in the user's leg as it pertains to the initial drive phase (first 3-6 steps) of a sprint. The machine can be collapsed for transport and re-assembled without the use of tools.

12 Claims, 4 Drawing Sheets

Elevation View

U.S. PATENT DOCUMENTS 6,071,217 A * 6/2000 Barnett ..... 482/121
6,120,425 A * 9/2000 Endelman ..... 482/142
6,149,554 A * 11/2000 Ferguson ..... 482/83
6,186,929 B1 * 2/2001 Endelman et al. ..... 482/121
6,238,322 B1 * 5/2001 Hsu ..... 482/96
6,338,704 B1 * 1/2002 Endelman ..... 482/142
6,371,895 B1 * 4/2002 Endelman et al. ..... 482/135
6,527,685 B2 * 3/2003 Endelman et al. ..... 482/121
6,585,625 B1 * 7/2003 Ferguson ..... 482/83
6,589,142 B2 * 7/2003 McAfee, Jr. ..... 482/133
6,685,606 B2 * 2/2004 Endelman ..... 482/142
6,872,186 B2 * 3/2005 Branch et al. ..... 601/5
6,926,650 B2 * 8/2005 Endelman et al. ..... 482/121
6,971,976 B2 * 12/2005 Endelman et al. ..... 482/121
7,044,898 B2 * 5/2006 Kuo et al. ..... 482/121
7,104,937 B2 * 9/2006 Arbuckle et al. ..... 482/142
7,125,368 B2 * 10/2006 Endelman ..... 482/142
7,125,369 B2 * 10/2006 Endelman ..... 482/142
7,163,500 B2 * 1/2007 Endelman et al. ..... 482/142
7,232,404 B2 * 6/2007 Nelson ..... 482/140
7,288,053 B2 * 10/2007 Endelman et al. ..... 482/142
7,288,054 B2 * 10/2007 Endelman et al. ..... 482/142
7,438,673 B1 * 10/2008 Jones ..... 482/71
7,682,297 B2 * 3/2010 Graham ..... 482/122
7,722,512 B2 * 5/2010 Liang et al. ..... 482/130
7,803,095 B1 * 9/2010 LaGree ..... 482/140
7,874,968 B2 * 1/2011 Foucault ..... 482/112
7,878,951 B2 * 2/2011 Roman et al. ..... 482/72
2001/0056011 A1 * 12/2001 Endelman et al. ..... 482/121
2002/0058573 A1 * 5/2002 Endelman et al. ..... 482/142
2003/0032534 A1 * 2/2003 McAfee, Jr. ..... 482/133
2003/0119636 A1 * 6/2003 Endelman ..... 482/142
2003/0195095 A1 * 10/2003 Endelman et al. ..... 482/142
2004/0053752 A1 * 3/2004 Yang ..... 482/70
2004/0138029 A1 * 7/2004 Brausen ..... 482/51
2004/0167000 A1 * 8/2004 Schwarz ..... 482/123
2004/0176227 A1 * 9/2004 Endelman ..... 482/142
2005/0113226 A1 * 5/2005 Endelman et al. ..... 482/142
2005/0113227 A1 * 5/2005 Endelman et al. ..... 482/142
2006/0199712 A1 * 9/2006 Barnard et al. ..... 482/142
2009/0118108 A1 * 5/2009 Uygan ..... 482/135

* cited by examiner

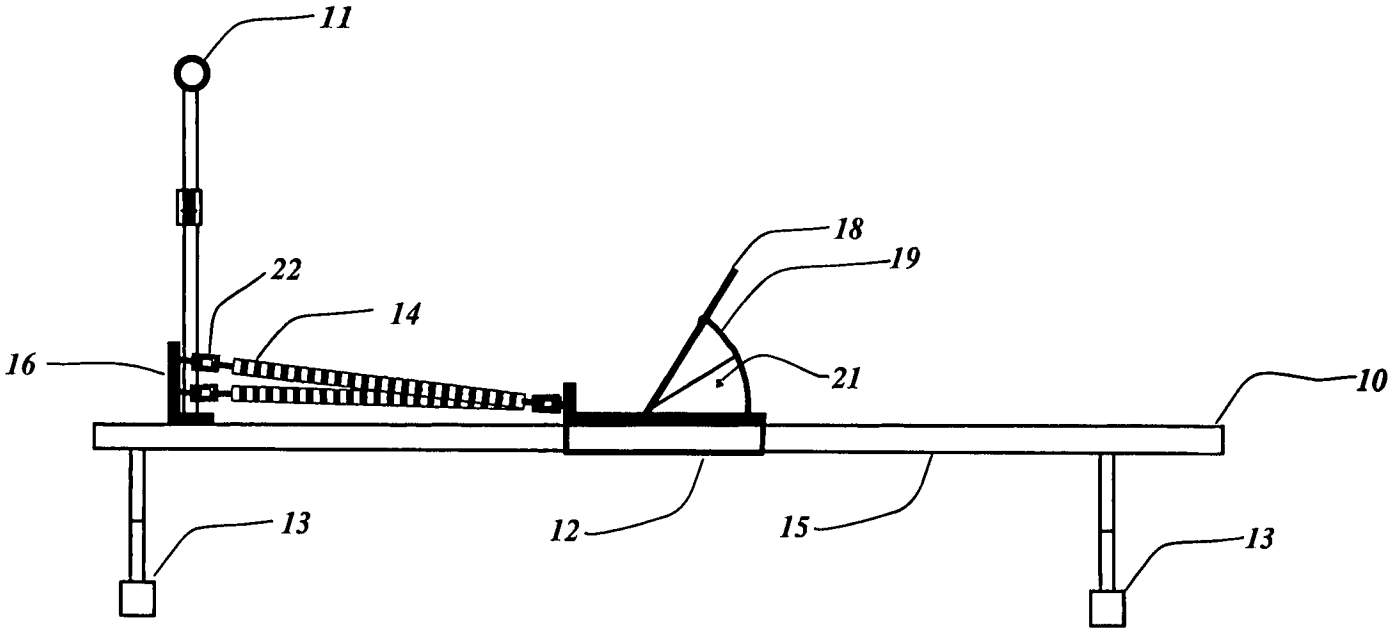
Figure 1, Elevation View

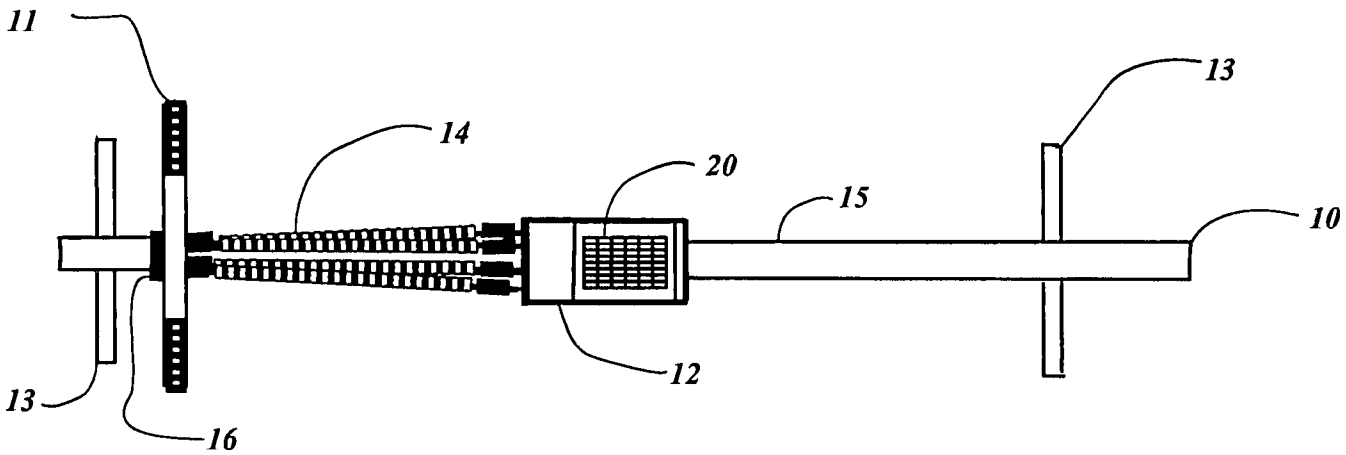
Figure 2, Plan View

Elevation Rear View
Foot Sled Detail

Elevation Front View
Handle Stand &
Leg Assembly Detail

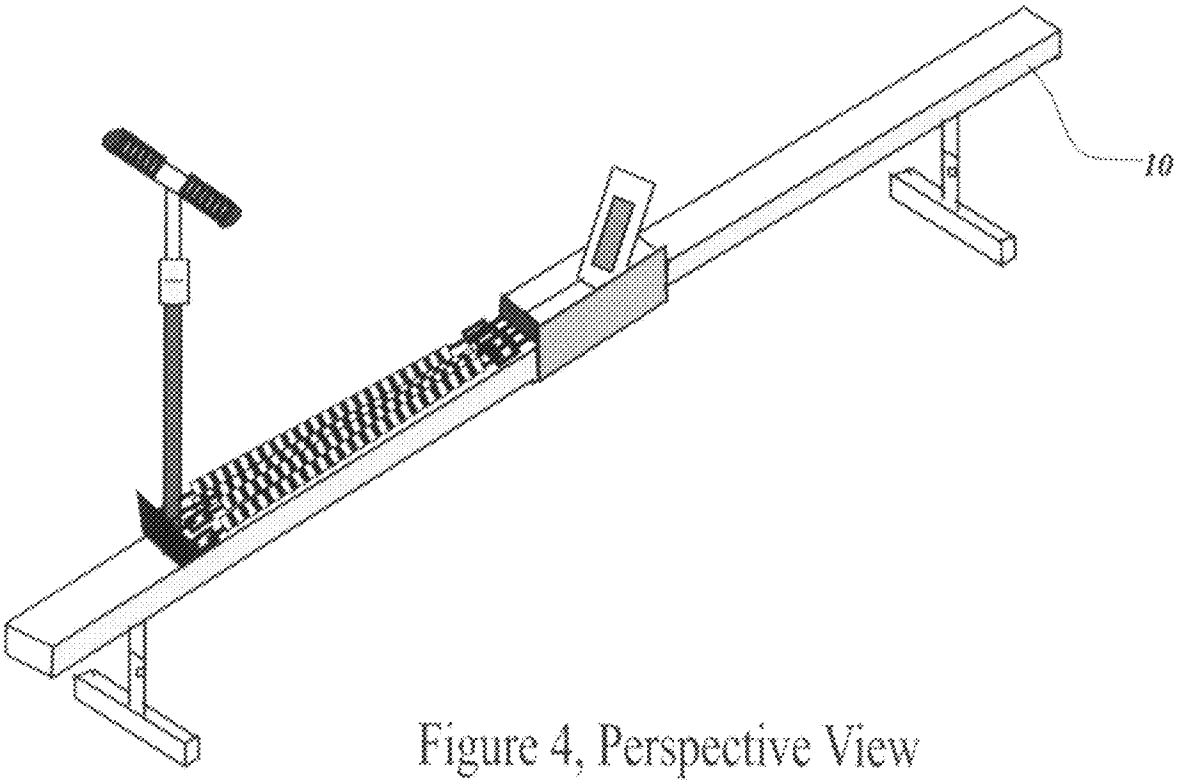
Figure 4, Perspective View

LEG EXERCISE MACHINE

CROSS-REFERENCE TO RELATED APPLICATIONS

None

STATEMENT REGARDING FEDERALLY SPONSORED RESEARCH OR DEVELOPMENT

None—Not Applicable

REFERENCE TO SEQUENCE LISTING, A TABLE, OR A COMPUTER PROGRAM LISTING COMPACT DISK APPENDIX

None

BACKGROUND OF THE INVENTION

The invention is directed to be a hand portable exercise and training machine to improve the user's initial linear quickness and speed from a set or stationary position. This machine is designed to give coaches, trainers, athletes, or bodybuilders at any level a functional, portable alternative to the larger stationary gym based equipment that exploits this same range of functional muscular movement of the legs. It also has a quite positive aesthetic effect on the user's legs. This machine can be used at any stage of periodization: Anatomical Adaptation, Hypertrophy, Maximum strength, Conversion to power, or Maintenance phase. Also, at low resistance it can be utilized in dynamic warm-ups. This machine's function and portability make it a must for any team or individual with a need for speed-development or enhancement.

Endelman et al in U.S. Pat. No. 6,971,976 developed a concept of a movable carriage on a horizontal frame operating against elastic or spring resistance devices. The elastic or spring resistance is applied from the movable carriage to the fixed position, horizontal frame. This Endelman et al exercise machine positions the user in a recumbent, horizontal (laying down) orientation and exercises the user's body trunk and legs in that position. Due to the user position (recumbent instead of upright—standing), the Endelman et al machine is designed to exercise different user muscle groups than those exercised by the machine proposed in this application.

Sleamaker in U.S. Pat. No. 5,328,427 developed a device using movable foot pads connected by cables to a spring loaded one-way clutch driver. The spring loaded one-way clutch driver is also connected by cables to elevated "ski pole" hand grips. The Sleamaker exercise machine positions the user in an upright, standing orientation but the leg movement is restricted to a lateral (sideways) direction. The lateral direction restriction simulates the side ways motion required by ice skating and cross-country skiing. Due to this lateral leg motion direction restriction, the Sleamaker machine is designed to exercise different user leg muscle groups than those exercised by the machine proposed in this application.

Both Endelman et al and Sleamaker employ standard engineering techniques such as telescoping, removable or collapsing features to enhance the portability or storability of their exercise equipment. The machine proposed in this application also employs telescoping and removable features to enhance the portability or storability.

The key to successful linear sprinting is a powerful and technically sound initial drive phase which comprises the first six to eight steps of a sprint. The first step out of the blocks requires the runner to achieve triple extension of the hip, knee, and ankle joints. Then the runner must hold a 45 degree angle from toe off to head, in order to place maximum force into the ground, this angle trains the "acceleration vector." This first six to eight steps is not easy to train or develop. So by putting the runner in the start position per the machine defined in this application, the runner can then work the first step against the resistance of the springs to full extension of the hip, knee, and ankle and gain maximal range of motion strength.

The acceleration vector mentioned above, comes from load vector terminology, which can be used to clarify the differences between Endelman's reformer exercise apparatus which trains the jump vector, Sleamaker's skating and skiing simulator, which trains the cutting vector. Whereas, the machine proposed in this application trains the acceleration vector.

In order to understand load vector training terminology, you simply need to analyze which direction the load is moving in relation to the human body. Muscular activation is directly correlated to the directional load vector. The primary load vectors can be defined as follows:

- Sprint Vector: Characteristic of top speed sprinting with upright posture, moves weight forward and backward in relation to the upright human body
- Acceleration Vector: Characteristic of forward acceleration with 45 degree lean, halfway between sprint vector and jump vector
- Jump Vector: Characteristic of jumping, moves weight up and down in relation to upright human body
- Backpedal Vector: Characteristic of backpedaling or moving backwards
- Cutting Vector: Characteristic of lateral cutting and sideways movements
- Twisting Vector: Characteristic of twisting or rotating motions Athletes need to prepare for all the vectors related to their sport. It is very difficult to keep things simple and train all the various load vectors. Usually, the jump vector is heavily loaded in the weight room and the other vectors are trained with bodyweight only on the field through speed and agility training. Training more vectors in the athlete's strength program will maximize performance and reduce injuries. The machine defined in this application is targeted to train both a movement and its associated muscles. The targeted movement being trained is the acceleration vector as defined above.

In summary, the Endelman et al and Sleamaker exercise machines' are designed to exercise very different user muscle groups than those exercised by the machine proposed in this application. The Endelman et al and Sleamaker designs position the user in different body orientations and the user's motions when using these devices are very different than the machine proposed in this application. The machine proposed in this application is primarily targeted at leg muscles used to initiated and maintain forward motion as employed during running or walking and during the initiation of those activities. Again, the user orientation and exercise motions for the machine proposed in this application are very different than either the Endelman et al or Sleamaker exercise machines.

Remarks

Beyond the differentiating details provided above, the applicants offer the following arguments further citing why this proposed patent is structurally unique when compared to previously patented devices. These differences are as follows:

- The exercise machine proposed in this application has a handle bar vertical height which is adjustable and telescopes 14" to 28" to enable proper alignment of each user's upper body. Body positioning as it relates to exercise, enables the exerciser to emphasis the joint and muscle movement they wish to exploit. The leg exerciser machine proposed in this application has a vertical handlebar that adjusts from 14 to 28", which positions the user as a runner would be positioned at the start of a sprint. The proper angle of the head and torso is achieved by adjusting the vertical handle bar. Once this angle is correct the user can strengthen the leg muscles from a position which could then be easily transferred to running start speed. Endelman's and Sleamaker's patents do not allow the user to achieve this angle.

The exercise machine proposed in this application has a horizontal beam is approximately 84" long to allow full extension of the user's torso and leg. This proposed machine is designed to develop or enhance strength in the legs as it relates to running movement or speed. The proposed machine enables it's user to develop leg strength through a full range of motion (the user can fully extend the hip, knee and ankle joint). The length of the leg exerciser's horizontal beam ensures a full kickback motion extending to the end range of the user's leg drive. The inability to reach full extension and thus full range of motion would create a strength deficit and restrict the user from reaching their full strength potential. We contend that Endelman's and Sleamaker's patents, lacking this horizontal length, fall short of this needed range of motion.

The machine proposed in this application has a horizontal beam is elevated 10" to 20" above the floor to properly align the user's leg for operating the machine. It is adjustable to customize the beam's height for each user's individual body size. The user can then move his or her torso and hip to an angle which ensures proper alignment and maximum muscular development as it applies to leg drive (leg extending out and away from body). To begin the exercise, the user must straddle the horizontal beam and face the vertical handle bar (front). The user then grasps the handles for stability and places the exercising leg above and in line with the machine with the foot of the exercising leg pressed solidly against the foot plate provided on top. The user now tucks the torso and head in line with the machine with the working leg knee joint at a 90 degree angle and the body core engaged. This is the perfect starting position. The user then begins pressing back with the heel of the working leg thus engaging the hip (gluteals muscles) concentrically and the hamstrings group (bicep femoris, semitendinosis, and semimembranosis muscles) eccentrically to cause hip extension first, then as the leg extends further this is quickly joined by the quadricep group (rectus femoris, vastus lateralis, vastus medialis and vastus intermedialis muscles) which concentrically create extension at the knee. Then at full extension of the hip and knee, the user applies pressure through the ball of the foot just behind the toes, engaging the gastrocnemius and soleus muscles concentrically to plantar flex (extend) the ankle. Thereby, completely extending the hip, knee and ankle joints at the finish of the movement. We contend that the Endelman et al and Sleamaker patents and other prior patents for similar exercise equipment cannot elevate their base high enough to achieve this proper alignment and therefore cannot safely put their user in a functional kickback position making it impossible to engage the hip, knee (at a 90 degree angle starting position), and ankle in a manner such as the proposed leg exercise machine. This high horizontal beam elevation to enable at a 90 degree knee joint angle starting position is a very important feature of the proposed exercise machine that differentiates it from prior patents for similar exercise equipment.

In summary, the structural design of this proposed exercise machine has unique features to enable a full range of kickback motion with the proper body orientation of the user. This proposed design is very different than prior patents because of the unique structural configuration of the proposed exercise machine as described above. The above structural features of the proposed exercise machine substantially differentiate it from the Endelman et al and Sleamaker patents or a composite of both.

BRIEF SUMMARY OF THE INVENTION

This device is a hand portable exercise machine targeted at improving a user's quick start capability from a set or stationary position. The machine applies dynamic progressive spring resistance, where the resistance increases as the movement of the leg continues through the full exercise range. From the beginning of a sprint in any sport, body alignment is crucial to maximize leg drive into the ground. This machine allows for proper anatomical positioning, thus ensuring both safety and maximum muscle development as it applies to leg drive (leg extending out and away from the torso (upper body)).

BRIEF DESCRIPTION OF THE SEVERAL VIEWS OF THE DRAWING

FIG. 1, shows the leg exercise machine in an elevation view from its side

FIG. 2, shows a plan view of the leg exercise machine from above.

FIG. 4, provides a perspective view of the leg exercise machine from above

DETAILED DESCRIPTION OF THE INVENTION

Figure 5:
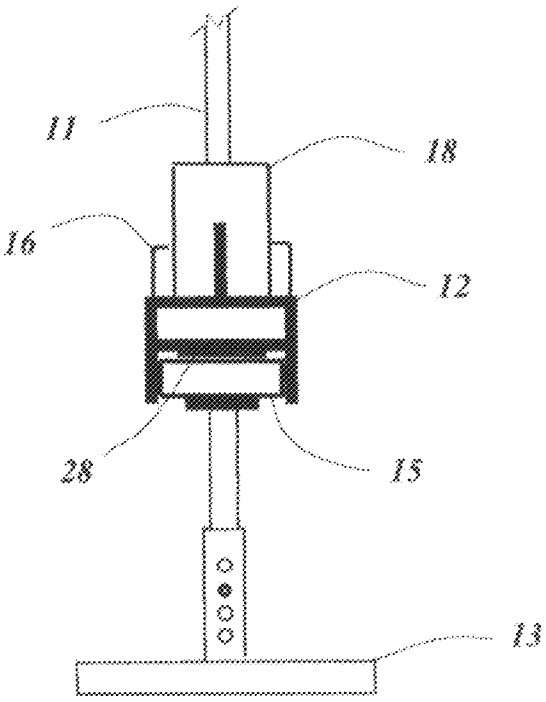
FIG. 5, shows an elevation view of the leg exercise machine from its rear
Figure 3:
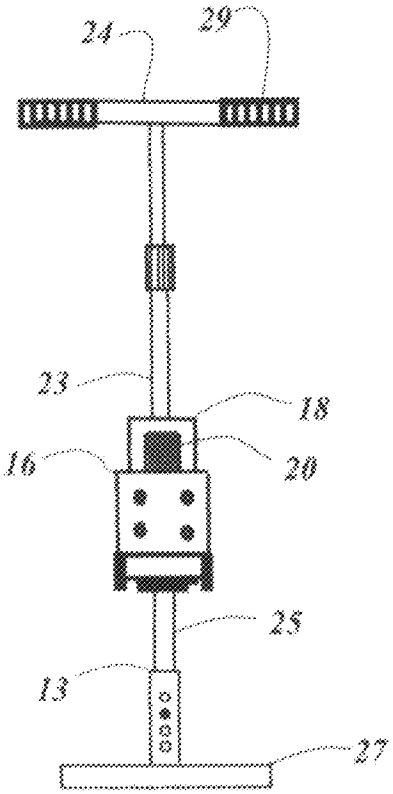
FIG. 3, shows an elevation view of the leg exercise machine from its front

The leg exercise machine 10 consists of a horizontal beam 15 that is elevated above the floor from 10 to 20 inches by adjustable legs 13. The beam height adjustment above the floor is to enable the most comfortable user height configuration. The height of the front and rear leg assemblies 13 can be independently adjusted to slope the horizontal beam to increase or decrease the amount of force required. The width of the leg assembly 13 at the floor surface is approximately 18 inches to provide adequate lateral stability. On the horizontal beam 15, are mounted a movable foot sled 12, a stationary spring retainer bracket 16 and a removable handle bar post assembly 11. The stationary spring retainer bracket 16 and handle bar post assembly 11 are mounted near the front of the horizontal beam. This assembly can be viewed in elevation and plan on Drawing—FIGS. 1, 2 3 and 5.

The foot sled assembly 12 slides on the horizontal beam. Springs 14 are attached to the front of the foot sled 12 and the opposite end of the springs 14 are attached to a stationary retainer bracket 16 adjacent to the vertical handle bar post 11. The springs 14 are about 22 inches in length, similar to standard garage door springs and can have a rating of up to 100 pounds force each when fully extended. Each spring 14 is attached at each end with removable clips 22. The number of interconnecting springs 14 can be changed from one (1) up to four (4) depending on the level of force desired by the user.

Also, the force rating of the springs 14 can be changed to suit the user by replacing them with differently rated springs. The vertical height of the handle bar stand post 11 can be adjusted via a lower 23 and upper 24 section to the user's preferred height.

The angle of the foot plate 18 on the foot sled 12 is also adjustable to the user's preference. The foot plat 18 angle is adjusted via a two piece support member 19 with a retaining pin 21 that is placed at the desired angle to maintain the foot plate 18 in that position. The foot plate is secured to the sled at its base by a hinge attachment. The foot plate two piece support member 19 consists of a bottom piece and a movable vertical member foot plate. The foot plate support vertical member allows the user to select a plate angle.

The foot plate 18 has an adhesively attached synthetic rubberized surface 20 for interfacing with the user's foot. The foot sled assembly 12 has a pad 28 at its base to minimize friction forces during sled movement along the horizontal beam 15. As noted above, the slope of the horizontal beam 15 can be adjusted by differing the support leg assembly 13 heights at each beam end to the increase or decrease the force needed to be applied by the user. Each leg assembly 13 is two piece 25 & 27 with a telescoping vertical section that can be secured in the desired position. These feature details are depicted in FIGS. 1, 2, 3 and 5.

The machine requires the user to straddle it facing the handle bar post assembly 11 taking hold of the handle bar 24 with both hands for stability and to counter leg movement forces. The user then places the leg he or she intends to exercise above and in line with the machine with the foot of the leg being exercised pressed against the foot plate 18 on the sled 12. The user's other leg remains firmly on the floor or ground. The user now tucks his or her torso and head in line with the machine with the working leg at a 90 degree angle with the body core engaged. The user is now in the correct position to execute this exercise.

To initiate the movement, begin pressing back with the heel of working leg thus engaging the gluteus maximus, concentrically and the hamstrings (biceps femoris, semitendinosus, and semimembranosus), eccentrically to cause hip extension first. Then, as the exercised leg extends, quickly joined by the quadriceps group (rectus, femoris, vastus medialis, vastus lateralis, and vastus intermedialis) which concentrically create extension at the knee—then at full extension of the hip and knee the user applies pressure through the ball of the foot just behind the toes, engaging the gasrocnemius and soleus muscles concentrically to plantar flex (extend) the ankle. Thereby, completely extending the hip, knee, and ankle joints at the finish of the movement, allowing the spring force to reverse this movement returns the user to the starting position.

This machine is designed to give coaches, trainers, athletes, or bodybuilders at any level a functional, portable alternative to the larger stationary gym based equipment that exploits this same range of functional muscular movement of the legs. It also has a quite positive aesthetic effect on the user's legs. This machine can be used at any stage of periodization: Anatomical Adaptation, Hypertrophy, Maximum strength, Conversion to power, or Maintenance phase. At low resistance, it can also be utilized in dynamic warm-ups. This machine's function and portability make it a must for any team or individual with a need for speed-development or enhancement.

The movement of the foot sled 12 is resisted by a variable number of springs 14. As such, it is recommended that the user fully learns the technique involved with proper posture and fully develops the strength required to complete 15-20 repetitious at low resistance before adding an additional springs.

We have the following claims regarding this exercise machine invention:

1. Resistance exercise apparatus comprising: a horizontal beam mounted on leg assemblies above the floor or finished grade, the legs are two independent assemblies one attached near the front and one near the rear of the beam, a stationary spring retainer bracket mounted on the beam, a movable foot sled with an adjustable angle foot plate assembly mounted to the beam, interconnecting springs between the stationary bracket and movable foot sled, and a vertical post handle bar assembly pendant mounted on the beam adjacent to the stationary spring retainer bracket; wherein a width of the foot plate assembly is larger than a width of the horizontal beam and the horizontal beam is disposed directly under the foot plate assembly.

2. Resistance exercise apparatus as set forth in claim 1, wherein the two leg assemblies are adjustable in height from approximately 10 to 20 inches above the floor or finished grade and these assemblies can also be independently adjusted in height to slope the horizontal beam.

3. Resistance exercise apparatus as set forth in claim 2, wherein the horizontal beam is approximately 84 inches in length.

4. Resistance exercise apparatus as set forth in claim 3, wherein the handle bar assembly folds down or is removable to allow for easier transport.

5. Resistance exercise apparatus as set forth in claim 4, wherein the handle bar assembly vertical post is adjustable in height and telescopes from approximately 14 up to 28 inches.

6. Resistance exercise apparatus as set forth in claim 5, wherein the foot sled assembly has a foot plate with an adjustable angle of approximately 60 to 120 degrees in arc from the horizontal with a removable retention pin that holds the plate at the selected angle.

7. Resistance exercise apparatus as set forth in claim 6, wherein the foot plate base has a hinged attachment to the sled which connects it to the sled and allows for an adjustable angle.

8. Resistance exercise apparatus as set forth in claim 7, wherein the foot plate on the sled is approximately 11 inches high and 5.5 inches wide with a synthetic rubberized surface for interfacing with the user's foot.

9. Resistance exercise apparatus as set forth in claim 8, wherein the foot sled bottom has a pad on its base to minimize friction when moved across the beam.

10. Resistance exercise apparatus as set forth in claim 9, wherein the quantity of springs is variable from one (1) to four (4) via use of detachable clips at each connecting spring end.

11. Resistance exercise apparatus as set forth in claim 10, wherein each spring is approximately 22 inches in length.

12. Resistance exercise apparatus as set forth in claim 11, wherein springs with different force ratings can be applied with springs rated at up to 100 pounds force each.

* * * * *